US011987925B2

(12) United States Patent
Stachnik et al.

(10) Patent No.: US 11,987,925 B2
(45) Date of Patent: May 21, 2024

(54) WATERPROOF MEMBRANE

(71) Applicant: E I DU PONT DE NEMOURS AND COMPANY, Wilmington, DE (US)

(72) Inventors: Mieczyslaw Michel Stachnik, Luxembourg (LU); Raul Fernandez Garcia, Masriudoms (ES)

(73) Assignee: DUPONT SAFETY & CONSTRUCTION, INC., Wilmington, DE (US)

( * ) Notice: Subject to any disclaimer, the term of this patent is extended or adjusted under 35 U.S.C. 154(b) by 1073 days.

(21) Appl. No.: 16/504,587

(22) Filed: Jul. 8, 2019

(65) Prior Publication Data

US 2019/0330796 A1 Oct. 31, 2019

Related U.S. Application Data

(63) Continuation of application No. 15/553,737, filed as application No. PCT/US2016/028255 on Apr. 19, 2016, now abandoned.

(Continued)

(51) Int. Cl.

| | |
|---|---|
| ***D06N 3/14*** | (2006.01) |
| ***D06N 3/18*** | (2006.01) |
| ***D06N 5/00*** | (2006.01) |

(52) U.S. Cl.

CPC ..... *D06N 3/142* (2013.01); *D06N 3/146* (2013.01); *D06N 3/147* (2013.01); *D06N 3/18* (2013.01);

(Continued)

(58) Field of Classification Search

CPC ..... D06N 3/142; D06N 3/146; D06N 3/147; D06N 3/18; D06N 5/00; D06N 2211/06; D06N 2213/03

See application file for complete search history.

(56) References Cited

U.S. PATENT DOCUMENTS

| | | | | |
|---|---|---|---|---|
| 9,410,062 | B1 * | 8/2016 | Khan | E04D 5/148 |
| 10,017,943 | B1 * | 7/2018 | Zhou | E04D 7/00 |

(Continued)

FOREIGN PATENT DOCUMENTS

| | | | |
|---|---|---|---|
| DE | 19609311 | A1 | 9/1997 |
| EP | 2248845 | A1 | 11/2010 |
| JP | H1150609 | A | 2/1999 |

OTHER PUBLICATIONS

International Search Report, dated Jul. 8, 2016 for corresponding International Application No. PCT/US16/28255, filed on Apr. 19, 2016.

*Primary Examiner* — Kelly M Gambetta

(57) ABSTRACT

The invention relates to a waterproof membrane for building applications comprising at least one support carrier and at least one layer of a cross-linked coating composition comprising at least one polyurethane. The invention also relates to a waterproof membrane comprising at least one support carrier and at least one layer of a cross-linked coating composition comprising at least one polyurethane, an optional pre-coating layer to facilitate the manufacturing process, and to join the support carrier with the cross-linked coating composition in the most optimal and durable manner to achieve good surface appearance and chemical bonding between reinforcing carrier and crosslinked polyurethane coating. The waterproof membrane can be prepared and installed with lower cost in comparison to current flat roof waterproofing systems based on liquid two-component polyurethane systems.

4 Claims, 5 Drawing Sheets

Related U.S. Application Data

(60) Provisional application No. 62/153,126, filed on Apr. 27, 2015.

(52) U.S. Cl.
CPC ..... *D06N 5/00* (2013.01); *D06N 2211/06* (2013.01); *D06N 2213/03* (2013.01)

(56) References Cited

U.S. PATENT DOCUMENTS

2005/0271882 A1* 12/2005 Walther ..... C09J 123/286
427/372.2
2010/0297902 A1* 11/2010 Smith ..... E04D 5/02
524/68
2017/0058510 A1* 3/2017 Seabaugh ..... E04B 1/625

* cited by examiner

WATERPROOF MEMBRANE

FIELD OF THE INVENTION

The present invention relates to a waterproof membrane and a waterproof system comprising the same. The waterproof membrane and the waterproof system can be used in building applications, particularly in roofing applications. The invention also relates to a process for producing the waterproof membrane and to a process for waterproofing a building or building part.

BACKGROUND OF THE INVENTION

In the building industry the waterproofing of flat roofs, terraces, balconies and the like is performed by various methods. Single ply systems can be used based, for example, on bitumen, polyvinylchloride and olefinic rubber. However, these single ply systems are not in all respects satisfactory.

Bitumen-based waterproofing sheets are usually fixed to the roof by means of flame heating. Thus, the support sheet has to be flameproof. Polyvinylchloride-based and olefinic rubber-based waterproofing sheets have to be glued on the support using adhesives. Typically the adhesives are made of ingredients which are not from the same chemical family as the material of the waterproofing sheet. This includes the risk of, bad adhesion, incompatibility and reduced resistances to ageing. Owing to tighter environmental law requirements, it is also becoming increasingly necessary to avoid using polyvinylchloride-based systems due to the migration of plasticizers used and general material ageing.

Resin-based liquid waterproofing materials are used for waterproofing. For example, two-component elastomeric polyurethanes, epoxy polyurethanes, polyesters, silicone, acrylic and methacrylic resins and lattices such as styrene/acrylic and acrylonitrile lattices.

Liquid applied polyurethane waterproofing systems typically rely on the application of liquid two-component polyurethanes comprising a resin and a cross-linker. Functional groups of resin and cross-linker react under outdoor conditions to provide a long lasting waterproof barrier adhering to the roofing base support materials such as concrete, steel, wood, insulating synthetic or natural boards. The curing speed depends on the outdoor conditions, i.e. mainly on the humidity and temperature.

Therefore, curing of the polyurethane layer results in a cross-linked base layer which may have different cross-linking density and different thickness. In addition a second layer (topcoat layer) of a liquid waterproofing two-component liquid polyurethane is typically applied upon the base polyurethane layer. This step is often combined with rolling out a thin mesh, for example, of polyester nonwoven. The reinforcing mesh is typically embedded between the first and second layer of the polyurethane coating. The base polyurethane layer has to be cured before application of the second polyurethane topcoat layer. In some cases the base polyurethane layer can be reinforced with a support carrier which is spread over the roofing base before the application of the liquid base polyurethane layer. Drying and curing time of the liquid polyurethane layers depend on the ambient conditions, in particular on the temperature. Drying and curing can take several hours at 10-20° C. and still few hours at 30-40° C.

Therefore, there remains a need to provide a waterproof membrane for building applications, in particular for roofing applications, which does not show the disadvantages of the prior art systems, and which specifically can withstand weather and UV ageing without having a negative effect on the waterproofing and sealing properties. The waterproof membranes shall also ensure fast, easy and reliable installation as well as long term performance.

SUMMARY OF THE INVENTION

The present invention relates to a waterproof membrane for building applications comprising at least one support carrier, and at least one layer of a cross-linked coating composition comprising at least one polyurethane, wherein said polyurethane is obtained from a composition comprising at least one compound having hydroxyl groups, and at least one polyisocyanate cross-linking agent with free isocyanate groups.

The present invention also relates to a process for producing the above waterproof membrane, comprising the steps of providing at least one support carrier, wherein the support carrier can be composed of a single layer or multiple layers; applying a layer of a coating composition comprising at least one compound having hydroxyl-functional groups, and at least one polyisocyanate cross-linking agent with free isocyanate groups; and curing the layer of the coating composition at temperatures in the range of 50° to 160° C.

Another embodiment of the invention is an optional pre-coating layer to facilitate the manufacturing process, and to join the support carrier with the cross-linked coating composition in the most optimal and durable manner to achieve good surface appearance and chemical bonding between reinforcing carrier and crosslinked polyurethane coating.

Another embodiment of the present invention also relates to the use of the waterproof membrane for waterproofing a building or a part of a building by applying the waterproof membrane as defined above to the building or part of the building.

DETAILED DESCRIPTION

Figure 1:
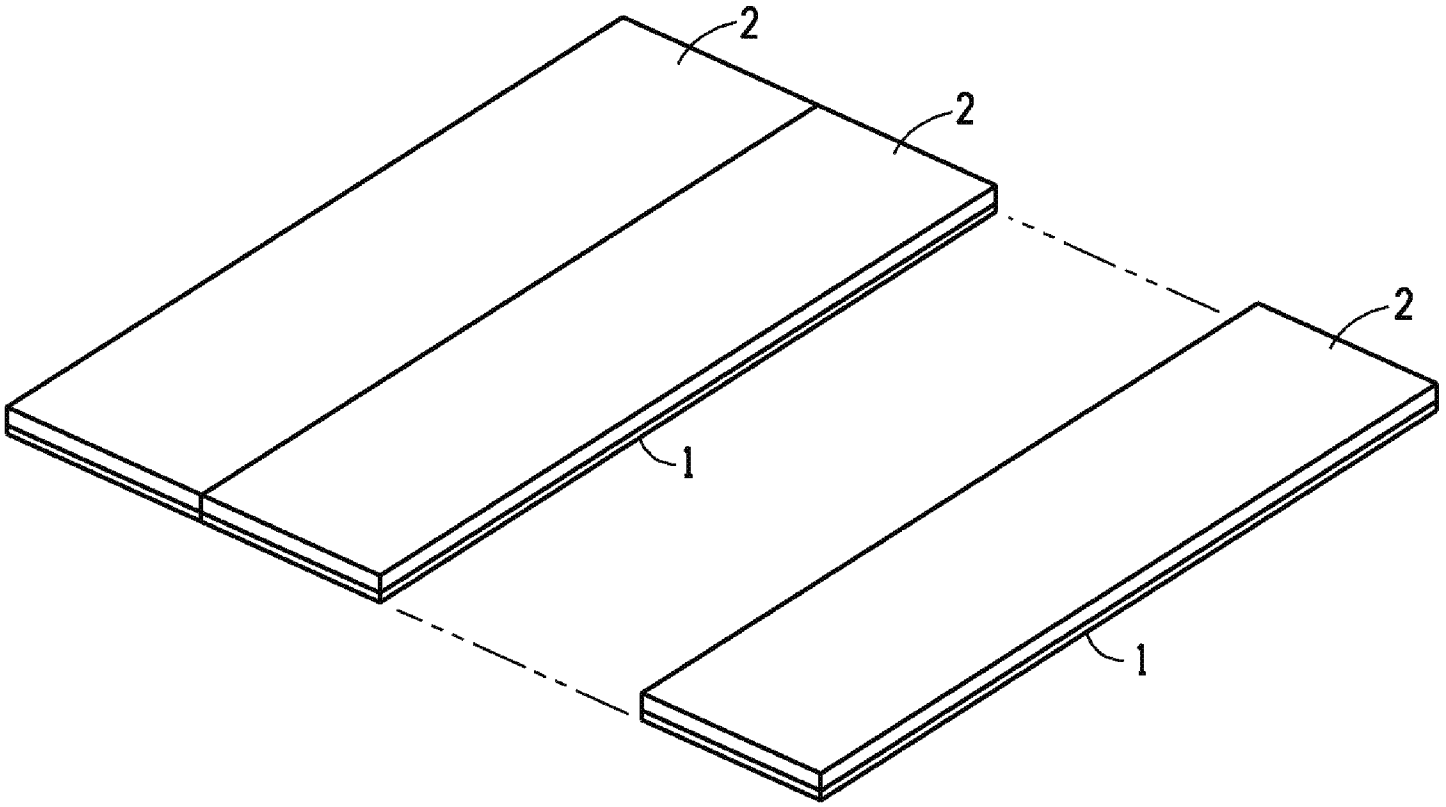
FIG. 1 illustrates an embodiment of installation of the waterproof membrane of the invention composed of a support carrier 1 and a polyurethane coating layer 2.

It is to be appreciated that certain features of the disclosure, which are, for clarity, described above and below in the context of separate embodiments, may also be provided in combination in a single embodiment. Conversely, various features of the disclosure that are, for brevity, described in the context of a single embodiment, may also be provided separately or in any sub-combination. In addition, references in the singular may also include the plural (for example, "a" and "an" may refer to one, or one or more) unless the context specifically states otherwise.

The term (meth)acrylic as used here and hereinafter should be taken to mean methacrylic and/or acrylic.

Unless stated otherwise, all the molar mass data, number average molar mass data Mn or weight average molar mass data Mw stated in the present description are molar masses determined or to be determined by gel permeation chromatography (GPC; divinylbenzene-crosslinked polystyrene as the immobile phase, tetrahydrofuran as the liquid phase, polystyrene standards).

The coating compositions to be used according to the invention are two-component coating compositions. The handling of two-component coating compositions generally requires mixing together the reactive components shortly before application to avoid premature reaction of the reactive components. The term "shortly before application" is well known to a person skilled in the art working with two-component coating compositions.

The time period within which the ready-to-use coating composition may be prepared prior to the actual use/application depends, e.g., on the pot life of the coating composition. Therefore, a sufficient long pot life is desired in order to have a comfortable time window for preparing/mixing and applying the two-component coating compositions. The pot life is the time within which, once the mutually reactive components of a two-component coating composition have been mixed, the coating composition may still be properly processed or applied and coatings of unimpaired quality can be achieved.

The term "waterproof membrane" means a sheet or membrane having the function to protect, e.g., a building or similar object against water and other environmental influences.

The waterproof membrane of the present invention is intended for building applications. The term "building applications" shall include any use of the waterproof membrane to protect buildings or any part of a building against water and other environmental influences, Parts of buildings to be protected with the waterproof membrane include, for example, roofs, balconies, terraces and the like. The waterproof membrane of the present invention comprises at least one support carrier and at least one layer of a two component polyurethane coating composition, The Support Carrier The support carrier serves as a reinforcing carrier to carry the layer of the two component polyurethane coating composition. The support carrier can be any self-supporting liner, sheet, mesh or netting. The support carrier can be porous or non-porous. Preferably the support carrier is a flexible sheet, for example, a flexible sheet of any fabric known in the fabric art, such as a nonwoven or woven, solid membrane or micro-porous film. Also, the support carrier can be a single sheet or be formed from a single layer, but can also be a combination of two or more sheets or two or more layers. The at least one support carrier can be made of polyethylene, polypropylene, polyester or polyimide polymers or combinations or mixed polymers thereof. A coextruded core-sheath fiber nonwoven can also be used as a support carrier. Also, mineral woven or nonwoven fabrics, for example, a glass fiber sheet, can be used as a suitable support carrier.

Suitable nonwoven or woven fabrics comprise one or more natural and/or synthetic (man-made) fibers or filaments. The synthetic (man-made) fibers or filaments can be chosen among polyamides, polyesters, polyimides, polyolefins, and mixtures thereof. Preferably the nonwoven fabric can be chosen among polyolefin or polyester nonwoven fabrics, or mixed polyolefin/polyester nonwoven fabrics. Polyolefin nonwoven fabrics can preferably be chosen among polyethylene nonwoven fabrics, polypropylene nonwoven fabrics or mixed polyethylene/polypropylene nonwoven fabrics.

Polyester nonwoven fabrics can preferably be chosen among polyethylene terephthalate (PETP) nonwoven fabrics, polyhydroxylalkanoate (PHA) nonwoven fabrics such as for example polylactic acid, or mixed PETP/PHA nonwoven fabrics.

More preferably, the nonwoven fabric is a polypropylene nonwoven fabric, for example a spun bond polypropylene nonwoven fabric. Spun bond polypropylene nonwoven fabrics are commercially available, for example the high strength polypropylene spunbond from E.I. du Pont de Nemours & Company. Polypropylene spun bond nonwoven fabrics allow high penetration of the two-component polyurethane resin inside the filament structure. On the other hand spun bond fabrics require less resin quantity to assure a full fabric impregnation compared to needle punched fabrics.

If a nonwoven fabric is used as support carrier the nonwoven fabric may be a combination of two or more individual layers of a nonwoven fabric. It may be, for example, a laminate combining two or more different types of nonwoven fabrics, such as for example, a laminate of at least one polyethylene nonwoven fabric and at least one polypropylene nonwoven fabric. Laminates of two or more different types of nonwoven fabrics known in the art are SMS laminates (Spun bond-Melt blown-Spun bond laminates).

The Two Component Polyurethane Coating Composition

The two component polyurethane coating composition of the present invention comprises components (a) and (b). Accordingly, the at least one layer of the coating composition is formed on the support carrier and comprises a polyurethane obtained by reaction of components (a) and (b). The at least one layer of the coating composition formed on the support carrier comprises components (a) and (b) in the cross-linked state, Components (a) and (b) which are reactive with each other shall be stored separately and mixed together only shortly before application. The at least one polyurethane comprises at least one component (a) having hydroxyl groups and at least one polyisocyanate cross-linking agent component (b).

Component (a) can be oligomeric or polymeric binders. The binders are compounds with a number average molar mass (Mn) of, e.g., 500 to 4000, preferably of 800 to 2000, The binders contain hydroxyl groups, but may also contain other functional groups with active hydrogen, e.g., primary and/or secondary amino groups. If amino groups are additionally present polyurethane/polyurea structures are formed during curing. The binders or compounds with hydroxyl groups are, for example, the polyester polyols, polyurethane polyols, polycarbonate polyols, polyether polyols, polylactone polyols and/or poly(meth)acrylate polyols or the corresponding multiple functionality polyols known from polyurethane chemistry by a skilled person. The binders can also be hybrid systems of the above polymers, for example, polyacrylate polyester polyol polymers, polyacrylate polyurethane polyol polymers or polyester polyurethane polyol polymers. They may each be used individually or in combination with one another. The binders with hydroxyl groups preferably have a number average molecular mass Mn of 500 to 4000 and a hydroxyl number of 25 to 150 mg KOH/g, more preferably a number average molecular mass Mn of 800 to 2000 and a hydroxyl number of 25 to 60 mg KOH/g. Component (a) can have a viscosity of 1000 to 20,000 mPas, preferably of 1000 to 15000 mPas, at 25° C. Polyether polyols which may be considered are, for example, polyether polyols of the following general formula:

$$H(O—(CHR_1)_n)_mOH,$$

in which $R_1$ means hydrogen or a lower alkyl residue (for example $C_1$ to $C_6$ alkyl), optionally with various substituents, n means 2 to 6 and m means 12 to 70. The residues $R_1$ may be identical or different. Examples of polyether polyols are poly(oxytetramethylene) glycols, poly(oxyethylene) glycols and poly(oxypropylene) glycols or mixed block copolymers which contain different oxytetramethylene, oxyethylene and/or oxypropylene units. Specific examples of polyether polyols or diols are polyethylene or polypropylene glycols, for example, with a number average molecular mass of 1000 to 4000. A further suitable example of a polyether polyols is polytetrahydrofuran, for example, with a number average molecular mass of 1000 to 2000.

Examples of polyester diols or polyols which can be used as component (a) include all polyester resins which are suited for coating applications, for example, hydroxyfunctional polyesters with a number average molecular mass of 500 to 1000, preferably, of 800 to 1000, an acid value of 0-50 mg KOH/g, and a hydroxyl value of 40-200 mg KOH/g, preferably, of 50-150 mg KOH/g. The polyesters may be saturated or unsaturated and they may optionally be modified with fatty acids. The polyesters are produced using known processes with elimination of water from polycarboxylic acids or carboxylic acid anhydrides and polyalcohols or transesterification reaction of e.g. dimethylesters of dicarboxylic acids with polyalcohols. Suitable polyols for the above mentioned synthesis are neopentyl glycol, ethylene glycol, butane diol, hexane diol and the like. Suitable polycarboxylic acids for the above-mentioned synthesis include adipic acid, maleic acid, phthalic acid, hexahydrophthalic acid, methylhexahydrophthalic acid and the like and the corresponding anhydrides if existent. Examples of polycarbonate polyols or diols comprise esters of carbonic acid which are obtained by reacting carbonic acid derivatives, for example diphenyl carbonate, dialkylcarbonates, e.g., dimethylcarbonate, or phosgene, with polyols, preferably with diols. Suitable dials are, for example, 1,3-propanediol, 2-methyl-1,3-propanediol, 1,4-butanediol, 1,3-butanediol, 1,5-pentandiol, 1,6-hexanediol, 3,3,5-trimethyl pentanedial, neopentylglycol and 2-ethyl-1,3-hexandiol.

Also, renewable resources such as natural oils, for example, castor oil and castor oil derivatives can be used as component (a). Castor oil is a natural product and comprises the triglyceride of castor oil fatty acid (ricinoleic acid), Natural castor oil is, for example, a mixture of 80-88% by weight of the triglyceride of castor oil fatty acid (ricinoleic acid), 4-7% by weight of the triglyceride of oleic acid, 3-5% by weight of linoleic acid, 1.5-2% by weight of palmitic acid and 1-1.5% by weight of stearic acid.

Hydroxyl-functional (meth)acrylic copolymers can also be used as component (a).

Component (b) comprises free isocyanate groups. The polyisocyanates can be any number of organic polyisocyanates with aliphatically, cycloaliphatically, araliphatically and/or aromatically bound free isocyanate groups. The polyisocyanates are liquid at room temperature or remain liquid through the addition of organic solvents. At 23° C., the polyisocyanates generally have a viscosity of 1 to 6,000 mPas, preferably, of 5 to 3,000 meas. The polyisocyanates may have an average NCO functionality of 1.5 to 5, preferably of 2 to 4. Examples of suitable polyisocyanates are those based on hexamethylene diisocyanate (HDI), 1-isocyanato-3,3,5-trimethyl-5-isocyanatomethyl-cyclohexane (IPDI), diphenylmethane diisocyanate (MDI), naphtylene diisocyanate (NDI), toluene diisocyanate (TM), and/or bis (4-isocyanatocyclohexyl)-methane. Triisocyanates, such as, triisocyanatononan can also be used as the polyisocyanate.

Sterically hindered polyisocyanates are also suitable. Examples of these are 1,1,6,6-tetramethyl-hexamethylene diisocyanate, 1,5-dibutyl-penta-methyldiisocyanate, p- or m-tetramethylxylylene diisocyanate and the appropriate hydrated homologues. In principle, diisocyanates can be converted by the usual methods to higher functional compounds, for example, by trimerization, dimerization or by reaction with water or polyols, such as, for example, trimethylolpropane or glycerine. Thus, the derivatives of the diisocyanates known per se can be used.

Generally, the polyisocyanates can be isocyanurates, uretdione diisocyanates, biuret group-containing polyisocyanates, urethane group-containing polyisocyanates, allophanate group-containing polyisocyanates, isocyanurate and allophanate group-containing polyisocyanates, carbodiimide group-containing polyisocyanates and polyisocyanates containing acylurea groups. The polyisocyanates can also be used in the form of isocyanate-modified resins or isocyanate-functional pre-polymers. Those isocyanate-functional resins or pre-polymers can be prepared in a known manner by reacting hydroxyl-functional compounds and isocyanate-functional compounds in a conventional manner known to the person skilled in the art, for example at temperatures of 50°-160° C., preferably of 70°-130° C., optionally with the addition of catalysts. Hydroxyl-functional compounds can be, for example, the polyols and diols described above as component a). Isocyanate-functional compounds can be, for example, the diisocyanates described above. The components are here reacted in quantities such that a reaction product with free isocyanate groups is obtained, i.e. the reaction is performed with an excess of polyisocyanate. For example, the reaction may be performed with an equivalent ratio of NCO groups:OH groups of 1.5:1.0 to 5.0:1.0, preferably of 1.6:1.0 to 4.0:1.0. The isocyanate-functional pre-polymer can preferably have an NCO content of 5.0 to 15.0%, particularly preferably of 6.0 to 15.0%. Aromatic polyisocyanates are the preferred polyisocyanates for economical reasons and aliphatic-isocyantes are preferred for UV and colour stale compounds.

Component (b) may also comprise blocked isocyanate groups in addition to free isocyanate groups. Isocyanate groups can be blocked with typical blocking agents. Low molecular weight compounds containing active hydrogen are known for blocking NCO groups. Examples of blocking agents are aliphatic or cycloaliphatic alcohols, dialkyl amino alcohols, oximes, lactams, phenols, imides, hydroxyalkyl esters and esters of malonic or acetoacetic acid. It must be ensured that a curing temperature is selected which allows deblocking of the isocyanate groups under curing conditions and allows the deblocked isocyanate groups to react with hydroxyl groups of component (a).

Generally the polyisocyanate cross-linking agents are those commonly used in the preparation of polyurethanes, and are described in detail in the literature. They are also obtainable commercially.

The two components (a) and (b) of the two component polyurethane coating composition are only mixed together shortly before application. The mixture of the two components should have a pot life of at least 30 minutes. The molar ratio of hydroxyl groups and other optional groups with active hydrogen of the least one compound (a) to the isocyanate groups of the at least one polyisocyanate cross-linking agent (b), is, for example, 1:1.05 to 1:2.0, in particular 1:1.10 to 1:1.20.

The two component polyurethane coating composition to be used according to the present invention may contain other binder components in addition to components (a) and (b). Other binder components may include curable binders containing functional groups and optionally cross-linkers with functional groups reactive with the functional groups of the curable binders. Examples of curable binders are (meth) acrylic homo- and copolymers with at least one unsaturated group. Suitable cross-linkers for the (meth)acrylic homo- and copolymers are, for example, compounds with at least one unsaturated group, which are capable to undergo radical polymerization with the unsaturated groups of the (meth) acrylic homo- and copolymers. Examples of compounds with an unsaturated group are alkyl vinyl acetate monomers. Other binder components may be binders without reactive functional groups, e.g. (meth)acrylic homo- and copolymers without functional groups. The other binder components may be present in the coating composition in amounts of 5 to 15% by weight, preferably of 5 to 10% by weight, based on the total amount of the coating composition. Examples of suitable (meth)acrylic copolymers are, for example, those with a number average molar mass Mn of 1,000-20,000, preferably, of 1,100-15,000, an acid value of 0-100 mg KOH/g. The (meth)acrylic copolymers can be prepared by free-radical polymerization of polymerizable, olefinically unsaturated monomers, optionally, in presence of oligomeric or polymeric polyester and/or polyurethane resins. Free-radically polymerizable, olefinically unsaturated monomers which may be used are monomers which, in addition to at least one olefinic double bond, also contain further functional groups and monomers which, apart from at least one olefinic double bond, contain no further functional groups.

The two component polyurethane coating composition to be used according to the invention can contain pigments, fillers and/or usual coating additives. For example, color pigments of organic or inorganic type can be used. Examples of inorganic or organic color pigments are titanium dioxide, micronized titanium dioxide, iron oxide pigments, carbon black, azo pigments, phthalocyanine pigments, quinacridone, or pyrrolopyrrole pigments. Examples of fillers are silicon dioxide, barium sulfate, talcum, aluminum silicate, magnesium silicate, calcium carbonate, aluminum hydroxide and magnesium hydroxide. Examples of additives usually used in coating compositions are light stabilizers, UV absorber, flow control agents, rheology-influencing agents, thickeners, anti-foaming agents, wetting agents, anti-cratering, crosslinking inhibitors and crosslinking accelerators. The additives are added in the usual amounts familiar to the person skilled in the art. Also, curing catalysts for the cross-linking reaction between components a) and b) can be used, for example, in amounts of up to 0.5% by weight based on the total coating composition. Generally, suitable catalysts for the cross-linking reaction are basic and organometallic catalysts. Examples are inorganic basic compounds, such as hydroxides and basic oxides of metals. Suitable examples of hydroxides of metals are sodium, potassium, calcium and magnesium hydroxide. Also, quaternary ammonium hydroxides, such as tetraethyl ammonium hydroxide, can be used. Furthermore, amines can be used as catalyst. Suitable amines that can be used are secondary monoamines, for example, morpholine, diethyl amine, dibutyl amine, N-methyl ethanol amine, diethanol amine, and diisopropanol amine. Also suitable are diamines and polyamines. Also, tertiary amines are a suitable class of basic catalysts. Examples of suitable tertiary amines include trimethyl amine, triethyl amine, triisopropyl amine, triisopropanol amine, N, N-dimethyl ethanol amine, dimethyl isopropyl amine, N, N-diethyl ethanol amine, 1-dimethyl amino-2-propanol, 3-dimethyl amino-1-propanol, 2-dimethyl amino-2-methyl-1-propanol, N-methyl diethanol amine, triethanol amine, N-ethyl diethanol amine, N-butyl diethanol amine, N,N-dibutyl ethanol amine, and N-ethyl morpholine. Also suitable are 1,4-diazabicyclo[2.2.2]octane (DABCO), 1,8-diazabicyclo [5.4.0]undec-7-ene (DBU), 1,5-diazabicylo [4.3.0]non-5-ene, guanidine, guanine, guanosine, melamine, and mixtures and derivatives thereof. Further examples of catalysts are tin catalysts, such as organotin carboxylates, e.g. dialkyl tin carboxylates of aliphatic carboxylic acids, such as dibutyltin dilaurate (DBTL).

The two component polyurethane coating composition may also contain a catalyst or initiator for the curing reaction of additionally present reactive binder components. For example, initiators for the radical polymerization of unsaturated (meth)acrylic homo- or copolymers with other unsaturated compounds may be present. All usual polymerization initiators for radical copolymerization can be considered, such as, aliphatic azo compounds, for example, azobis-isobutyronitrile or azobis-methylbutyronitrile, diazylperoxides, for example, dibenzoylperoxide, dialkylperoxides, for example, di-tertiary-butylperoxide or di-tertiary-amylperoxide, alkylhydroperoxides, for example, tertiary-butylhydroperoxide or peresters, for example, tertiary-butylperoxybenzoate. The additives may be added before or after mixing the two components (a) and (b). They can form part of component (a), or component (b), or of both component (a) and (b).

The two component polyurethane coating composition to be used according to the invention can be formulated as a 100% system, i.e. may have a solids content of 100%, but may also contain at least one organic solvent. The organic solvents may be present in amounts of 5 to 30% by weight based on the total coating composition. The organic solvents are solvents conventionally used in coating techniques. They may originate from the preparation of the binders or added separately. The moisture content of any solvent must be less of 0.05%, commonly known as urethane grade.

The two component polyurethane coating composition can also contain low molecular weight reactive components as chain extender. Useful chain extenders include compounds having a molecular mass of 50 to 1000 g/mol, preferably of 50 to 300 g/mol. The chain extenders are preferably di-functional. They are used in amounts of 1% to 10% by weight, based on the total amount of components a) and b). Examples of chain extenders are amino-functional and/or hydroxyl-functional compounds.

Optionally, it may be useful to use a pre-coating between the support carrier and the layer of two component polyurethane coating composition. A pre-coating is especially useful if the support carrier is a porous substrate, or if it has low ability to create a chemical bond to the polyurethane layer. Polyurethane formulations typically have low viscosity due to their highly polar nature. They tend to wet quickly on porous membranes. The spontaneous wetting of porous support carriers, for example a nonwoven, leads to non-uniform penetration of reactive polyurethane coating layer into the support carrier, creating some defects in the surface of the polyurethane and non-uniform thickness of the waterproof membrane. In some cases when the polyurethane coating composition is applied to a porous carrier it can pass through the carrier leading to equipment contamination. The problem of liquid penetration and passing through some porous reinforcing carriers can be overcome by use of some thixotropic additives and thickeners in the polyurethane formulation however an important increase in the viscosity of two components polyurethane formulation creates a risk of inclusion of some air bubbles into the coating and may lead to poor adhesion of this layer to the support carrier, surface defects, and impairment of mechanical properties. A good surface appearance of crosslinked polyurethane waterproof membrane is very important for installing this membrane on roofs, and surface defects will detract from the appearance. These difficulties can be countered by use of pre-coating layer which has to be applied before the application and curing of the polyurethane coating composition.

The pre-coating is also useful for creating strong bonding of the two component polyurethane membrane to the support carrier. Application of the pre-coat on the support carrier and application of the two component polyurethane coating composition on top of pre-coated support carrier can be done in two consecutive steps or in a single step depending on the drying and curing capabilities of commercial coating line on which the waterproof membrane is produced. Application of two coatings (pre-coat and topcoat on top of it) in a single pass through coating line is more economical but also more difficult to control all parameters of thickness and rate of curing. The pre-coating may be made with the same chemical base as top layer of polyurethane coating except with an addition of viscosity and rheology additive to create a thick, smooth and uniform layer on top and partly inside the reinforcing carrier. In case of use of synthetic liner, for example such as polypropylene base fibrous textile, this layer creates a new surface to which the regular topcoat formulated with two component reactive polyurethane composition can form a durable chemical bond. In some cases there is a preference to use a water or solvent based pre-coating formulation different from the two component polyurethane coating composition to allow for better control of wetting and curing of the pre-coat in an oven prior to application of the two component polyurethane coating composition. The pre-coat composition used is selected to provide a good balance between sealing of the support carrier to prevent the two component polyurethane coating composition passing through and still leaving enough open pores to allow a mechanical anchoring of the two component polyurethane coating composition.

Preparation and Application of the Pre-Coat and Topcoatinq Compositions

The pre-coat is preferably an aqueous dispersion of modified chlorinated polypropylene and polyurethane with mineral fillers. After application of the liquid dispersion by doctor blade on the naked fabric the resulting dry coated rate is approximately of 3.5 to 45 grs/m$^2$ and preferably of 15 to 25 grs/m$^2$. The pre-coat is then dried at 120° C. for 4 minutes.

The pre-coat is prepared by mixing the two waterborne resins in an open vessel and then adding, under fast stirring, mineral fillers until a homogeneous dispersion is achieved. Then, water is added up to the desired solids content. After this, convenient amounts of antisettling, antifoam and thickener additives are added. The pre-coat is then ready to use.

Application of the pre-coat is conveniently done at the doctor blade. First, the liquid pre-coat composition should be re-stirred to ensure proper dispersion of the filler. The liquid pre-coat composition is poured onto the support carrier and spread by the doctor blade, which is in contact with the support carrier, leaving with no apparent gap. The liquid, therefore, fills the spaces between fibers rather than forming a noticeable film on the surface of the support carrier. The pre-coated support carrier passes through an oven set at 120° C. for approximately 4 minutes and then it is rolled. After the oven, one can see that most, but not all of the inter-fiber space is filled with the pre-coat, but many small pores are remaining. The fabric must be dry before undertaking further processing steps to ensure no bubbling or blistering forms on the topcoat Preparation and Application of Two Component Polyurethane Topcoat The topcoat composition to be used in the present invention is a two component polyurethane which can be prepared by bringing component (a), component (b) and optional other components as described above together, stirring and thoroughly mixing all components. Measures shall be taken to avoid inclusion of air bubbles, which could negatively impact a proper film formation. Air bubbles can be removed, for example, by using a vacuum mixer.

The two components of the topcoat are prepared separately. Component (a) is prepared by mixing in a high-speed Cowles stirrer, equipped with vacuum. Polyol and liquid additives are added to the stirrer first. Second, the whole set of additives: anticratering, antifoam, surface additives and pigment are added. Thirdly, the catalyst is added. Lastly, the filler, molecular sieve and thickener are added. Stirring is continued until enough dispersion is achieved. After ensuring correct dispersion (particle size must be below 40 microns) a 30 minute vacuum is applied to remove all the trapped air. The vacuum is then removed and the liquid is discharged into drums. Moisture content must be measured after preparation. If component (a) is pre-made at a resin-manufacturing factory, a further degassing step can be done prior to use. In this case a suitable disperser, much as the manufacturing equipment, is needed. In that case, the whole composition is poured into the vessel, and stirred under vacuum for at least 30 minutes and then used immediately to prevent moisture pick up.

Component (b) is prepared by polymerization of mdi-modified monomers and polyols. The NCO/OH ratio is adjusted to a value that the final NCO is 12.5%. This is performed in a low-speed stirred reactor, with heating at 60° C. until the specified NCO content value is achieved. The liquid is then filtered and discharged into drums.

The topcoat composition can be applied by a variety of processes, for example, by means of spraying, brushing, rolling, knife coating or padding. The topcoat composition can be applied in one, two or more layers to only one or to both sides of the support carrier. The topcoat composition can be applied in a layer thickness of 0.5 to 5.0, preferably of 0.4 to 1.9 mm (layer thickness in the dried state). The support carrier can also be impregnated with the topcoat composition by dipping it into the coating composition for instantaneous impregnation of both sides of the support carrier, especially in cases where a mesh, netting or air open nonwoven is used as support carrier.

Curing of the Topcoat Composition

After application of the two component polyurethane topcoat to a support carrier, either with or without the optional pre-coat, the layer of topcoat composition can initially be flashed off to remove optionally present organic solvents. The applied coating layer is then cured by the cross-linking reaction of the hydroxyl-functional component (a) and the cross-linking agent component (b). Curing can be performed by exposing the topcoat layer to heat at temperatures of 50° C. to 160° C., preferably of 90° C. to 140° C., and more preferably of 100° C. to 120° C. The heat can be provided by convection or conduction in an oven or by radiation such as infra-red (IR) radiation. Curing times vary depending on the membrane thickness, the curing temperature and the curing unit power. Curing times may be in the range of 1 to 30 minutes. After curing, the waterproof membrane of the invention is formed.

Installation of the Waterproof Membrane

The waterproof membrane of the present invention is used in building applications, e.g. in waterproofing roofs, preferably flat roofs. The waterproof membrane can be used as a single element to provide waterproofing properties, but can also be used as part of a waterproof multilayer system in combination with additional elements or layers. The waterproof membrane can be used in a waterproof multilayer system comprising in addition to the at least one waterproof membrane at least one layer of a liquid primer or a layer of a liquid polyurethane adhesive; an additional elastomeric membrane reinforced with synthetic or mineral sheets; and a mesh or a grid, or a combination of a mesh and a grid. Therefore the present invention also relates to a waterproof multilayer system for building applications, in particular for roof applications, comprising a waterproof membrane as defined above, and at least one layer selected from a primer layer; a layer of an adhesive, in particular of a liquid polyurethane adhesive; an elastomeric membrane different from the waterproof membrane as defined above; and a top finish layer 7.

According to the waterproof multilayer system as defined above the roof or other parts of a building can be treated first with a primer, e.g. a liquid primer. The liquid primer is preferably based on a one or two-component polyurethane or epoxy resins. In a second step an adhesive can be applied to the primer layer, in particular a liquid polyurethane adhesive. In a third step the waterproof membrane of the invention can be applied, e.g., by rolling out the waterproof membrane side by side by overlapping the support carrier side with another roll of the waterproof membrane and gluing them on the roof base support. If appropriate a thin top finish layer 7, e.g., of a liquid colored topcoat can be applied and cured under outdoor conditions, i.e. under conditions of application.

Figure 2:
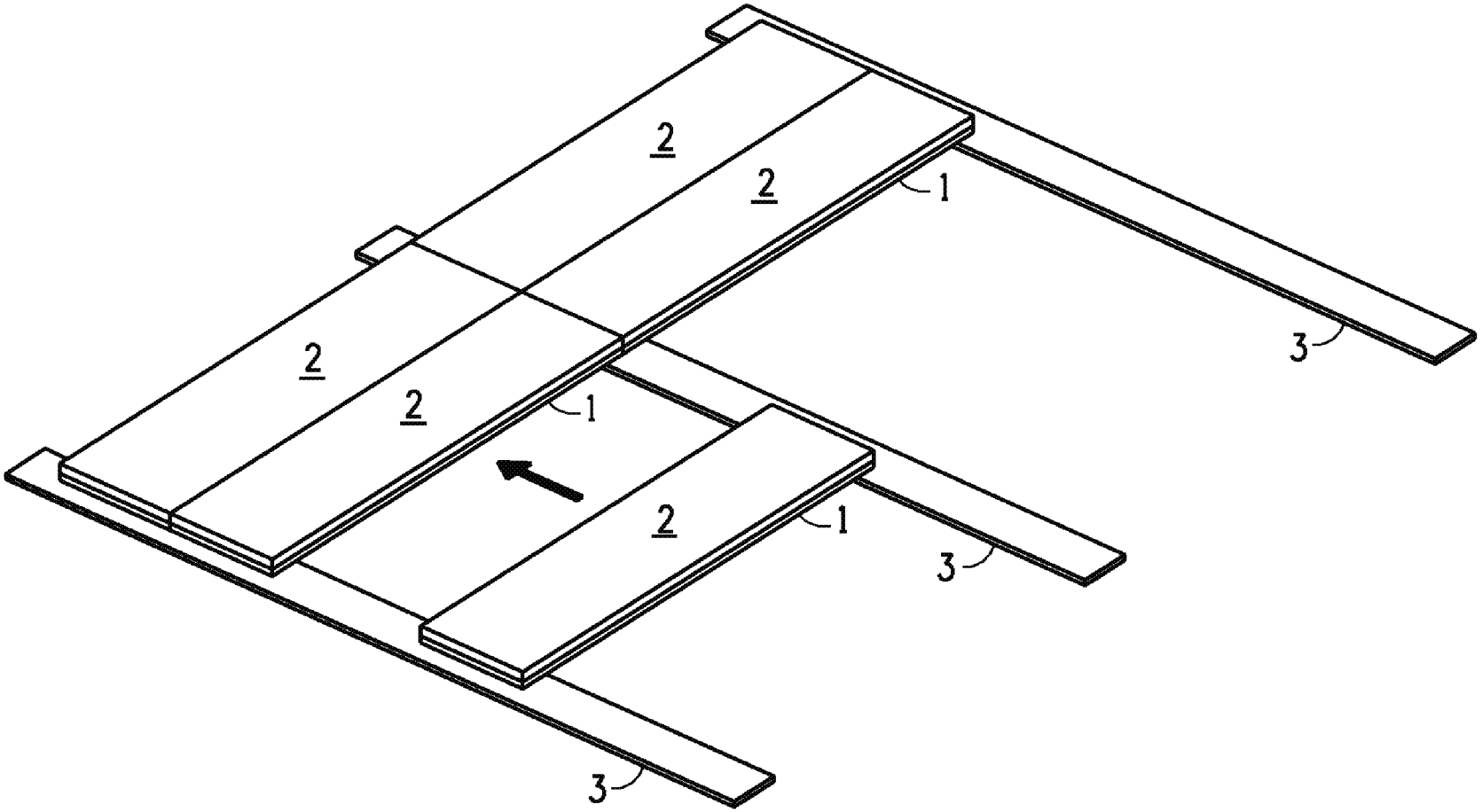
FIG. 2 illustrates a further embodiment of installation by using a seaming strip 3.

The waterproof membrane can be delivered in roll form. The installation of the waterproof membrane can be performed as illustrated in FIGS. 1 and 2. The waterproof membranes can be assembled side by side without "sticking out" overlaps in both directions. This results in a fully continuous seamless membrane surface which is less sensitive towards mechanical damages and particularly suitable for green roofing applications.

Figure 3:
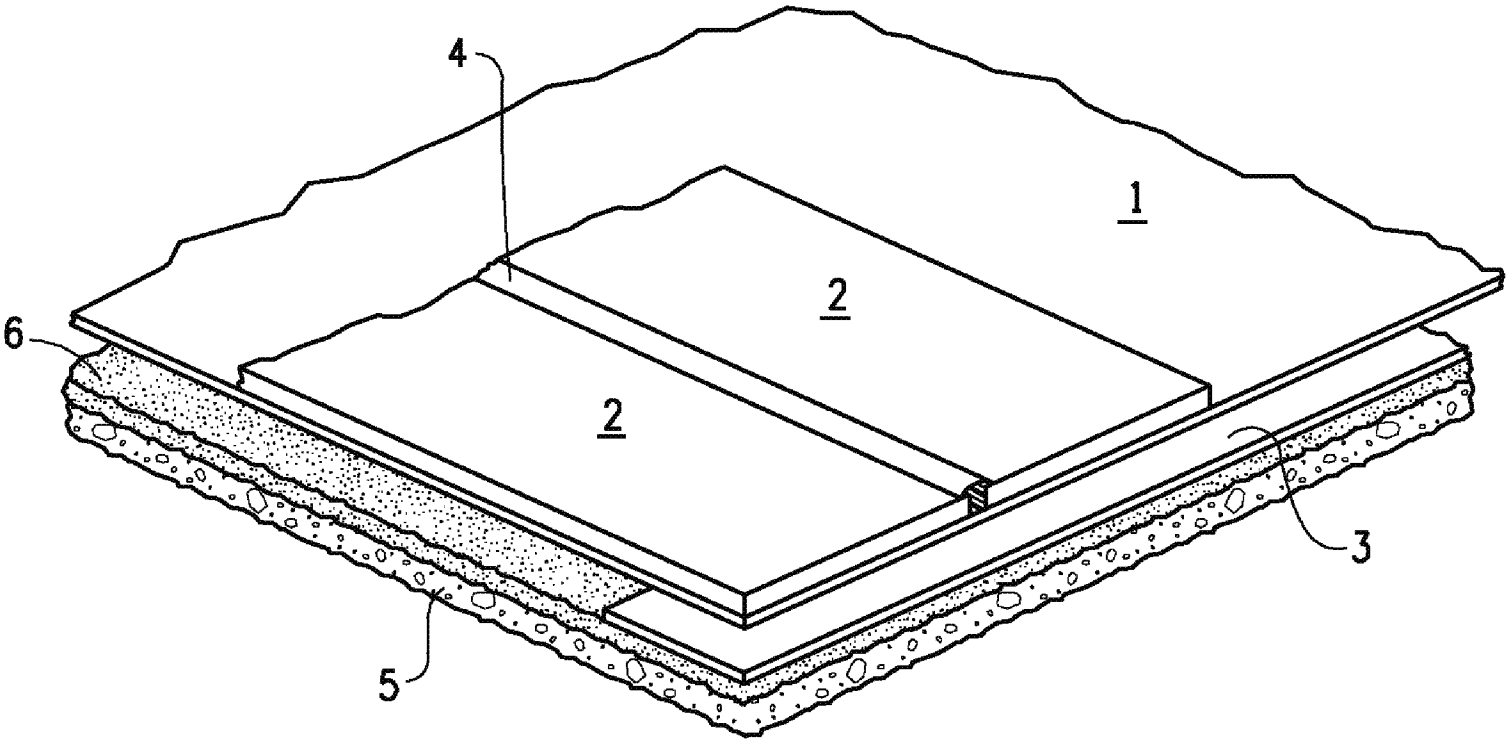
FIG. 3 illustrates an installation detail of FIG. 2 with a liquid polyurethane sealing layer 4, a roofing primer 5, seaming strip 3, and an adhesive layer 6.

As illustrated in FIG. 3, a roof or roof support can be first treated with a liquid roofing primer 5. In a second step the primer surface is sprayed over with a liquid polyurethane adhesive 6. In a third step the waterproof membrane of the invention is applied. The rolls of the waterproof membranes are disposed side by side with help of seaming strips 3 which are typically glued with the roofing primer 5 to the roof support base 8. Finally a liquid polyurethane sealing layer 4 can be filled, e.g. manually, between two adjacent layers of the waterproof membranes thereby creating a sealing of the overlapping area. A thin liquid layer of polyurethane adhesive 6 could be used for bonding the waterproof membrane of the invention to the primer layer 5. In some cases the same adhesive formulation can be used for layers 4 and 6.

Figure 4:
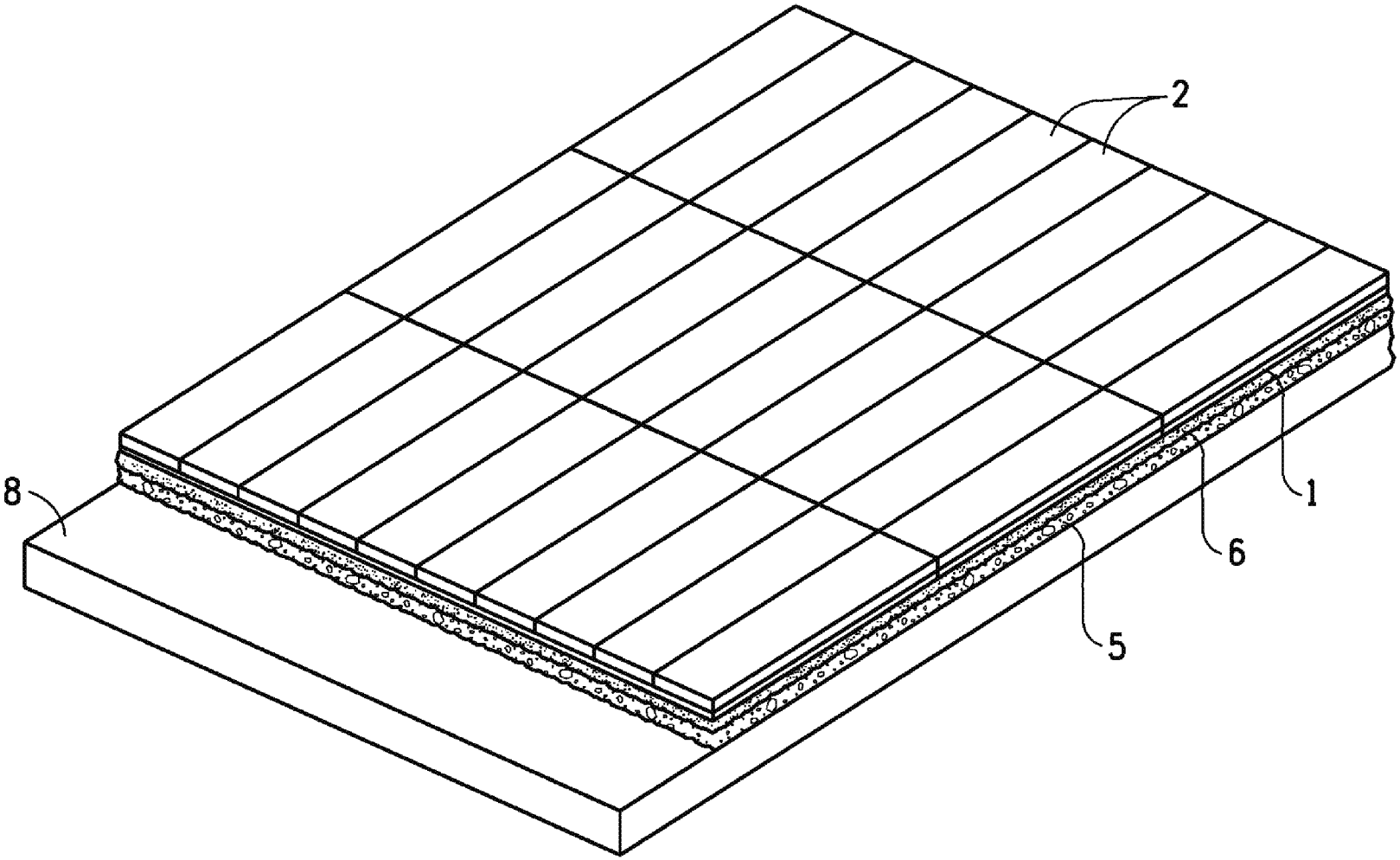
FIG. 4 illustrates a waterproof system of the invention without a top finish layer, but with a roofing primer 5, an adhesive layer 6 and a roof support 8.

As illustrated in FIG. 4, according to one embodiment, the waterproof membrane may be installed without a top finish layer 7, but with a first adhesive layer 6 on a flat roof support 8 which can be pre-treated with a roofing primer 5. The membrane itself is then the final waterproofing barrier.

Figure 5:
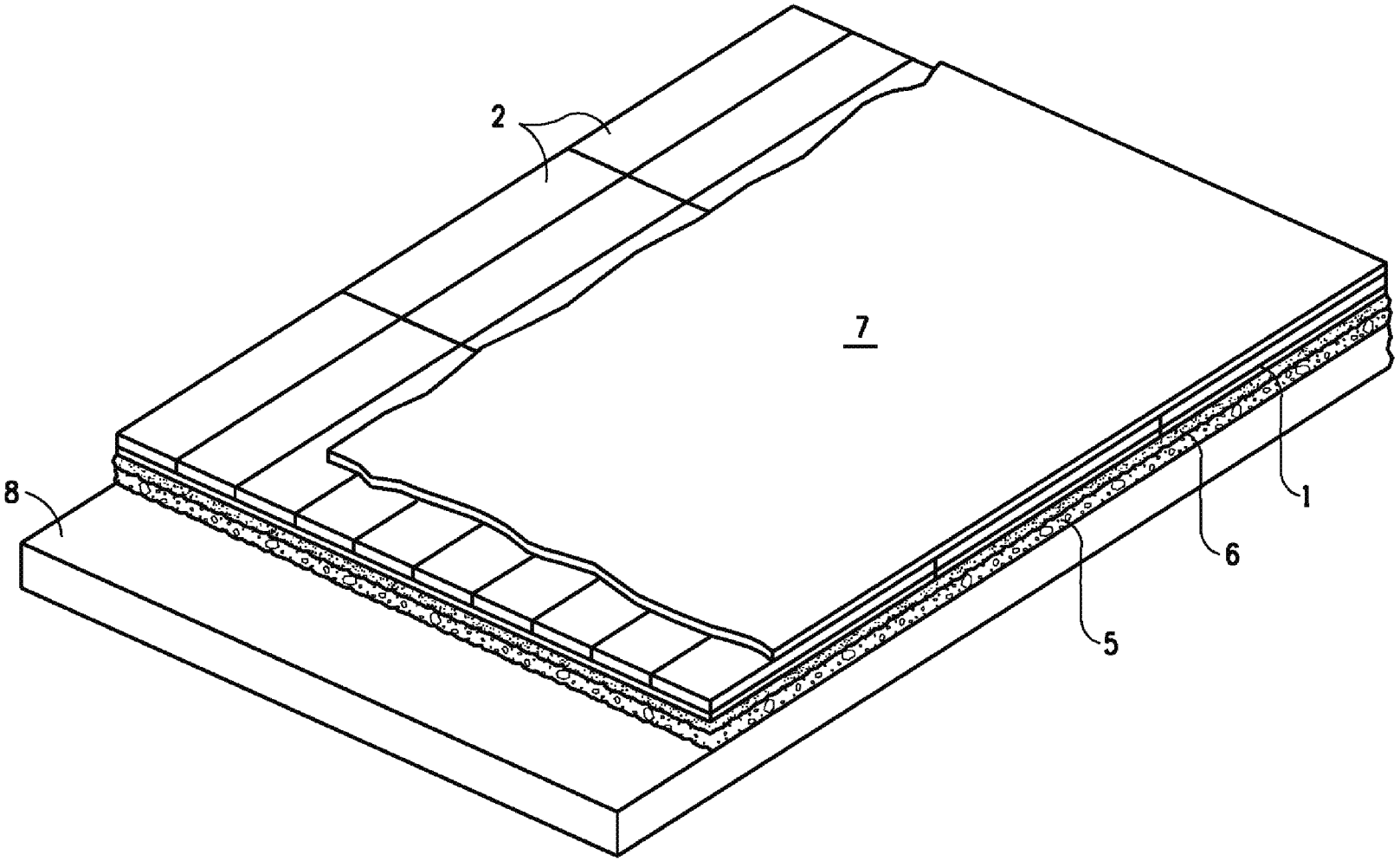
FIG. 5 illustrates a waterproof system of the invention with a primer layer 5, an adhesive layer 6 and a top finish layer 7.

As illustrated in FIG. 5 according to a further embodiment the waterproof membrane can be installed with a top finish layer 7. The waterproof system is composed of the top finish layer 7 of a liquid two-component polyurethane, which is applied to the waterproof membrane of the invention, which on the other hand is glued together with the roofing primer 5 to the flat roof support 8 by the liquid polyurethane adhesive 6. The liquid polyurethane adhesive and top finish layer 7 can be cured under outdoor conditions, i.e. under installation conditions.

The waterproof membrane of the present invention and the process for producing the same allow a better control of the thickness, physical properties and durability of the membrane compared to existing waterproof membrane solutions of the prior art. The quality of the polyurethane layer does not depend on the curing conditions (temperature, humidity) when installing the waterproof membrane.

The main advantage of the waterproof membrane of the present invention and the most important difference compared with prior art solutions is that the waterproof membrane is fully prepared before its application to the building or building part, i.e. the two-component coating composition is applied to the support carrier and fully cross-linked before the application of the waterproof membrane to the building or building part. According to prior art solutions two-component liquid polyurethane coating compositions are directly applied to the base of a roof or to a roof support and cross-linked only after application to the building or building part. Thus, the waterproof membrane of the present invention can be installed, e.g., in roofing or other building applications much easier and faster compared to existing waterproof membranes. Also, the waterproof membranes can be prepared and installed with lower cost in comparison to current flat roof waterproofing systems based on liquid two-component polyurethane systems. The waterproof membrane of the present invention is preferably used in building applications, but other applications are also possible.

The present invention is more particularly described in the following example which is intended as illustrative only, since numerous modifications and variations therein will be apparent to those skilled in the art.

EXAMPLES

Example 1

Note: in this example, Component (a) refers to the resin (polyol) component of a polyurethane system and Component (b) refers to the isocyanate component.

All the contents of drum containing a minimum of 200 kg of Component (a) (Krypton "S-Membrane A", which is a hydrophobic polyol-based composition with catalyst and pigment manufactured by Krypton Chemical, having a typical viscosity of 40000 mPa·s at 25° C. (Brookfield, 10 rpm, spindle s64) and an equivalent weight of 954 g/equivalent) were poured into a sealable container equipped with a lid with a low speed stirrer (able to stir close to the walls and bottom) and vacuum equipment able to apply a minimum 50 mm Hg vacuum. The container was closed and stirred under vacuum at 60-100 rpm for at least 30 minutes. Following this, the vacuum was removed and an air-operated transfer piston pump (Model Vega, from LARIUS-Italy, Ratio 5/1, pressure 3-8 bas, 10 liters/min at 66 cycles) was inserted and the container covered with a protective sheet to prevent excessive exposure to air and contamination. A drum containing component (b) (Krypton "S-Membrane B", which is an aromatic isocyanate terminated prepolymer with a viscosity of 2000 mPa·s (20° C., Brookfield, 100 rpm spindle s64) and isocyanate content of 13.5% manufactured by Krypton Chemical) was opened and an air-operated transfer piston pump (Ratio 5/1, by GAMA-Spain) was inserted and fitted with a silica-gel cartridge moisture-preventing device. The outlets of both pumps are connected to the corresponding feeding ports of component (a) (resin) and component (b) (isocyanate) of a variable ratio-proportioned machine, model EVOLUTION VR by GARRAF MAQUINARIA (GAMA, Sitges, Spain) with adjustable mixing ratio. Settings of the machine were as follows:

Heating unit Resin-Component (a): 30° C.

Heating unit Isocyanate-Component (b): 30° C.

Hose: 30° C.

Pressure: 70 bar

The mixing ratio between A (resin) and B (isocyanate) is 2.1:1 by volume.

Mixing chamber-gun type: At the end of the hose on the variable ratio-proportioner machine, a spraying gun model SOLVENT by GAMA (Sitges-Spain) was fitted and a section of polypropylene static mixer by DOTEST (Barcelon-Spain), 12.5 mm internal diameter, 400 mm length was attached to the outlet in order to ensure correct mixing without air entrapment. Both components were recirculated for 10 minutes until they reached the set temperature before proceeding with application of liquid coating on top of reinforcing carrier which was the high strength polypropylene spun bond fabric produced by E.I. du Pont de Nemours & Company. The doctor blade gap was set at 1.50 mm and the coated roll was fed to the coating line at speed of 5 m/min. The coated carrier passed through 12 m long of oven set at 120° C. along all the heating sections.

Example 2

Application of the Precoat

A pre-coat composition Precoat Membrane Primer, which is a primer formulation manufactured by Krypton Chemical for coating of a high strength polypropylene spunbond, and is based i44 on polyurethane dispersions with a solids content of 16.2% by weight, was homogenized in its original container using an electrical stirrer at low speed until all the contents were evenly dispersed.

The curing of pre-coating formulation was done in a 12 m long oven divided into 4 sections (3 m each) with independently adjustable temperature, manufactured by Berenguel (Barcelona), under license by Bruckner. Set a chain of vertical holding needles. The temperature was set at 120° C. in all sections.

The pre-coating formulation was applied by directly pouring it from the original container right before a scrapping doctor blade being in contact with the moving the high strength polypropylene spunbond fabric that spread the liquid along a 1.5 m wide section. The pre-coated fabric went into the oven 12 m long and the line speed was set at 3.7 m/min. After passing the oven, the pre-coated roll was recoiled and stored for next step. The approximate obtained pre-coating coverage was 40 g/m2 when dry, equivalent to 100 g/m2 in the wet stage before drying it in the oven.

Application of the Topcoat

All the contents of the drum containing a minimum of 200 kg of Component (a) (Krypton "Membrane A", which is a polyol-based composition with catalyst and pigment manufactured by KC, having a viscosity of 1800 mPa at 20° C. (Brookfield, 50 rpm, spindle S63) and an equivalent weight of 2050 g/equivalent) were poured into a sealable container equipped with a low speed stirrer (able to stir close to the walls and bottom) and vacuum equipment able to apply a minimum 50 mm Hg vacuum. The container was closed and stirred under vacuum at 60-100 rpm for at least 15 minutes. Following this, the vacuum was removed and an air-operated drum pump (Model Vega, from LARIUS-Italy, Ratio 5/1, pressure 3-8 bas, 10 litres/min at 66 cycles) was inserted and the surface of the liquid covered with a thin layer of a non-miscible hydrocarbon solvent Exxsol D100 (hydrocarbon fluid from Exxon Mobil Chemical), poured in such a way that there was no distortion of the Component (a) surface. Enough fluid was poured so that all the surface of Component (a) was covered and protected from atmospheric moisture with a 1-cm thick fluid layer.

A drum containing component (b) (Krypton "Membrane B", aromatic isocyanate terminated prepolymer with a viscosity of 600 mPa·s (Brookfield, 100 rpm, spindle s63) and isocyanate content of 13% also manufactured by Krypton Chemical) was opened and an air-operated transfer piston pump (Ratio 5/1, by GAMA-Spain) inserted and fitted with a silica-gel cartridge moisture-preventing device. The outlets of both pumps were connected to the corresponding feeding ports of component (a) (resin) and component (b) (isocyanate) of a plural-proportioner machine, model EVOLUTION G50H by GARRAF MAQUINARIA (GAMA, Sitges, Spain) with chamber for isocyanate of 60 cm3 and 120 cm3 for polyol in order to deliver a fixed ratio. The air necessary to power the pumps and mixing machine was supplied by an oil-free, air-dried compressor delivering at least 500 l/min. Settings of the G50 machine were as follows:

Heating unit Resin-Component A: 30° C.

Heating unit Isocyanate-Component B: 30° C.

Hose temperature 30° C.

Pressure: 70 bar

At the end of the G50 hose, a spraying gun model SOLVENT by GAMA (Sitges-Spain) was fitted and a section of polypropylene static mixer by DOTEST (Barcelon-Spain), 12.5 mm internal diameter, 400 mm length was attached to the outlet in order to ensure correct mixing without air entrapment. The static mixer was inserted in a steel tube to protect operator in case of accidental breakage of the mixer. Both components were recirculated until they reached the set temperature and for 10 minutes further before proceeding with application.

After equipment equilibration and checking pressure balance, the precoated high strength polypropylene spunbond fabric having an approximate thickness of 1.5 mm was fed from its roll with a smooth precoat surface up, at a speed between 3.5 and 4 m/min. The reacting mixture was poured gently in a manner to avoid splashing on the precoated fabric before a doctor blade (manufactured by Jacobs Weis) set at an opening gap of 1.5 mm. The four sections of the drying oven were set at the following temperatures First section: 120° C.

Second section: 80° C.

Third section: 80° C.

Fourth section: 70° C.

Each section was allowed to reach equilibrium before proceeding with application of the mixture of top coating to get cured in the oven.

What is claimed is:

1. A process for waterproofing a building or building part, comprising the steps of:

(A) producing a cross-linked waterproof membrane using the steps of:

(a) providing a support carrier comprising a spunbond polypropylene nonwoven fabric;

(b) precoating a side of the support carrier by
  i) applying a precoating formulation to the support carrier,
  ii) spreading of the precoating formulation using a scrapping doctor blade in contact with the support carrier to fill inter-fiber space in the support carrier, and
  iii) drying,
  to create a new surface to which a topcoat layer can bond;

(c) topcoating the new surface of the support carrier by
  i) applying to the new surface a two-component polyurethane coating composition, wherein the two-component polyurethane coating composition comprises at least one material having hydroxyl-functional groups, and at least one polyisocyanate cross-linking agent with free isocyanate groups,
  ii) spreading the two-component polyurethane coating composition with a doctor blade set at an opening gap from the new surface, and
  iii) curing the topcoat layer in an oven at temperatures in the range of 90° to 140° C.

to produce a cross-linked waterproof membrane; and (B) installing the cross-linked waterproof membrane on the building or building part with an adhesive.

2. The process of claim 1, wherein the two-component polyurethane coating composition further comprises a catalyst for the curing reaction between at least one material having hydroxyl-functional groups and the at least one polyisocyanate cross-linking agent with free isocyanate groups.

3. The process of claim 1, wherein the precoating formulation is an aqueous dispersion of chlorinated polypropylene and polyurethane with mineral fillers.

4. The process of claim 1, wherein in step (B), the cross-linked waterproof membrane is installed on the building or building part as part of a waterproof multilayer system comprising the cross-linked waterproof membrane, a layer of adhesive, an additional reinforced elastomeric membrane, additionally with a mesh or a grid or the combination of a mesh and a grid.

* * * * *